US005251517A

United States Patent [19]

Thevis

[11] Patent Number: 5,251,517

[45] Date of Patent: Oct. 12, 1993

[54] HARMONICA CONSTRUCTION

[75] Inventor: Paul Thevis, Oberndorf, Fed. Rep. of Germany

[73] Assignee: Matth. Hohner AG, Trossingen, Fed. Rep. of Germany

[21] Appl. No.: 969,475

[22] Filed: Oct. 30, 1992

[30] Foreign Application Priority Data

Nov. 2, 1991 [DE] Fed. Rep. of Germany ..... 4136124

[51] Int. Cl.[5] ..... G10D 7/12

[52] U.S. Cl. ..... 84/377

[58] Field of Search ..... 84/375, 377, 378, DIG. 14

[56] References Cited

U.S. PATENT DOCUMENTS 2,595,382 5/1952 Hugin ..... 84/377
2,687,058 10/1954 Obst ..... 84/377
2,718,808 7/1955 Magnus ..... 84/377

*Primary Examiner*—Michael L. Gellner
*Assistant Examiner*—P. Stanzione
*Attorney, Agent, or Firm*—Chilton, Alix & Van Kirk

[57] ABSTRACT

A harmonica is comprised of three components, namely a housing shell, a lid and a sounding board. The lid snaps into engagement with the housing shell and, when so engaged, urges the sounding board against internal walls on the housing shell which define reed compartments.

20 Claims, 1 Drawing Sheet

HARMONICA CONSTRUCTION

BACKGROUND OF THE INVENTION

1. Field of the Invention

The present invention relates to reed-type musical instruments and particularly to harmonicas. More specifically, this invention is directed to the manufacture of mouth organs and especially to minimizing the number of component parts to thereby facilitate the assembly of such instruments. Accordingly, the general objects of the present invention are to provide novel and improved apparatus and methods of such character.

2. Description of the Prior Art

Harmonicas having reed compartments are well known in the art. The reed compartments of such instruments are defined by a pair of oppositely disposed side walls, the inner surface of a shell or housing defining member and a sounding board. The sounding board will support multiple reeds with a pair of reeds typically being associated with each compartment. The prior art harmonica will also be provided with a lid or cover which, during assembly of the instrument, will be attached to the shell. A harmonica of the type being discussed is shown at page 76 of the publication entitled "Alles uber Reparaturen von Akkordeons Melodicas Mundharmonikas" (Complete Guide to Repairing Accordians, Melodicas and Harmonicas) published by Matth. Hohner AG in 1978. Such prior harmonicas are comprised of a plurality of parts, i.e., a reed compartment defining body, upper and lower sounding boards, upper and lower lids and a multiplicity of screws.

A harmonica which is formed from two housing shells which are integrated by mechanical fasteners is shown in British Patent 592,076. In the harmonica of this British patent, reed compartment wall sections, which are brought into engagement with one another, must be precisely formed in the two cooperating housing shells. A sounding board is provided for each reed compartment, and these sounding boards are inserted between the associated reed compartment wall sections and clamped in position when the instrument is assembled through the use of plural attachment screws. In the harmonica of this British patent, accordingly, assembly requires manipulation of a significant number of individual parts.

A harmonica which employs a snap-on lid or cover member may be seen from German Patent 3,235,034.

A significant deficiency of the above-described prior art harmonicas resides in the fact that the assembly thereof is, because of the relatively large number of parts which must be manipulated, labor intensive and thus comparatively expensive.

SUMMARY OF THE INVENTION

The present invention overcomes the above-briefly discussed and other deficiencies of the prior art by providing a novel and improved harmonica which is formed from a small number of individual parts which are easy to manipulate and integrate into a completed instrument. The present invention also encompasses a unique method of manufacture of a harmonica which requires a relatively small number of parts and eliminates the need for use of any tools in the final assembly.

A harmonica in accordance with a preferred embodiment of the invention has reed compartments which are defined by the back wall of a housing shell member, compartment side walls which are integral with and extend inwardly from the shell member back wall and a sounding board. A harmonica in accordance with the invention also includes a lid which is provided, on its inwardly directed surface, with contact elements. The lid and housing shell are configured so that they may simply be snapped together to establish a mechanical connection therebetween. Thus, on one side, the lid is received in an undercut or recess formed in the shell. A first end portion of the sounding board is, upon engagement of the lid in this recess, clamped in position between the shell and lid. The sounding board is further urged against the free ends of the reed compartment side walls by the contact elements on the lid and, accordingly, is sealingly clamped to the walls.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE DISCLOSED EMBODIMENT

Figure 3:
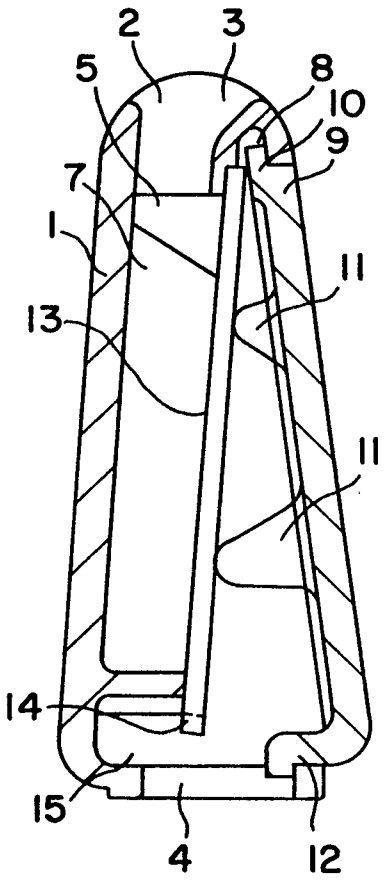
FIG. 3 is a view similar to FIG. 2 taken along Line B—B of FIG. 1.

With reference to the drawing, a harmonica in accordance with the invention comprises a shell 1 which, as will be described below, defines an open-sided housing. Housing shell 1 has a continuous back wall which terminates, at a first end, in a curved mouthpiece defining portion 2. The mouthpiece defining portion 2 includes a linear array of exhalation/inhalation ports 3, defined in part by partitions 16, through which the player causes air to flow. In the disclosed embodiment, the housing shell 1 also includes a pair of side walls and, disposed oppositely to the mouthpiece 2, a second end portion which is provided with an array of expiration/aspiration ports 4. The housing shell 1 is further provided with a plurality of generally parallel compartment defining walls 5 which extend from the back wall toward the open side of the housing. The back wall of the housing and the compartment walls 5 cooperate, in the manner to be described, with a sounding board 13 to form reed compartments 6.

The mouthpiece 2 is provided, in a side edge thereof which is generally oppositely disposed with respect to the back wall of the housing shell, with a continuous recess or undercut 8. The undercut 8, as may be seen by joint configurations 2 and 3, defines locating and support surfaces for the sounding board 13.

Figure 2:
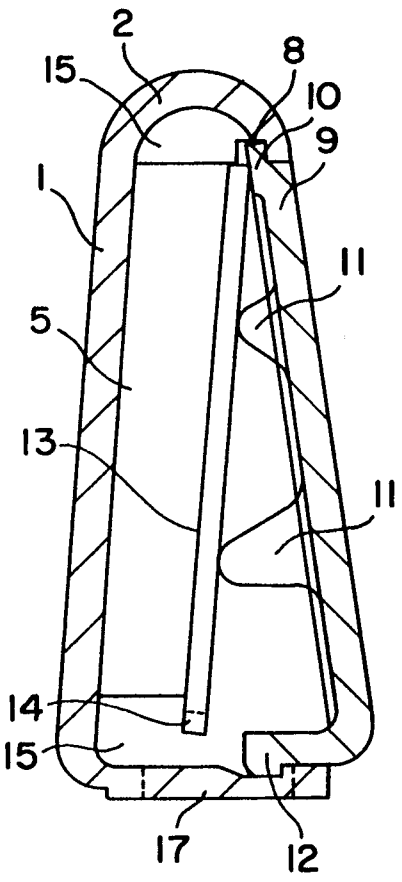
FIG. 2 is a cross-sectional side elevation view taken along Line A—A of FIG. 1.

A harmonica in accordance with the invention further comprises a lid member 9 which, at a first end, is provided with a reduced thickness shoulder portion 10. Shoulder 10 is sized and shaped to be received in the recess 8. The lid 9 is also provided with contact elements 11 which protrude from the inner side of the lid. The contact elements 11 may be in the form of cams, i.e., elements 11 may have smoothly curved contact surfaces, which apply force to the sounding board 13. Alternatively, the contact elements 11 may be spring struts or similar resilient members which function to apply a resilient bias to the sounding board 13. The contact elements 11 are preferrably aligned with some or all of the reed compartment walls 5 and may be provided singly or in pairs as shown. The lid 9 is further provided, at the edge region thereof which is disposed oppositely with respect to shoulder 10, with a plurality of inwardly extending locking members 12. The members 12 are, in the disclosed embodiment, hook-like elements which are designed to snap into a locked condition as depicted in FIGS. 2 and 3 in response to the application of a compressive force to the lid 9 after the shoulder 10 has been positioned in the recess 8.

The housing shell 1 and the lid 9 are preferably formed as injection moldings, i.e., as a pair of separate interlocking parts.

Figure 1:
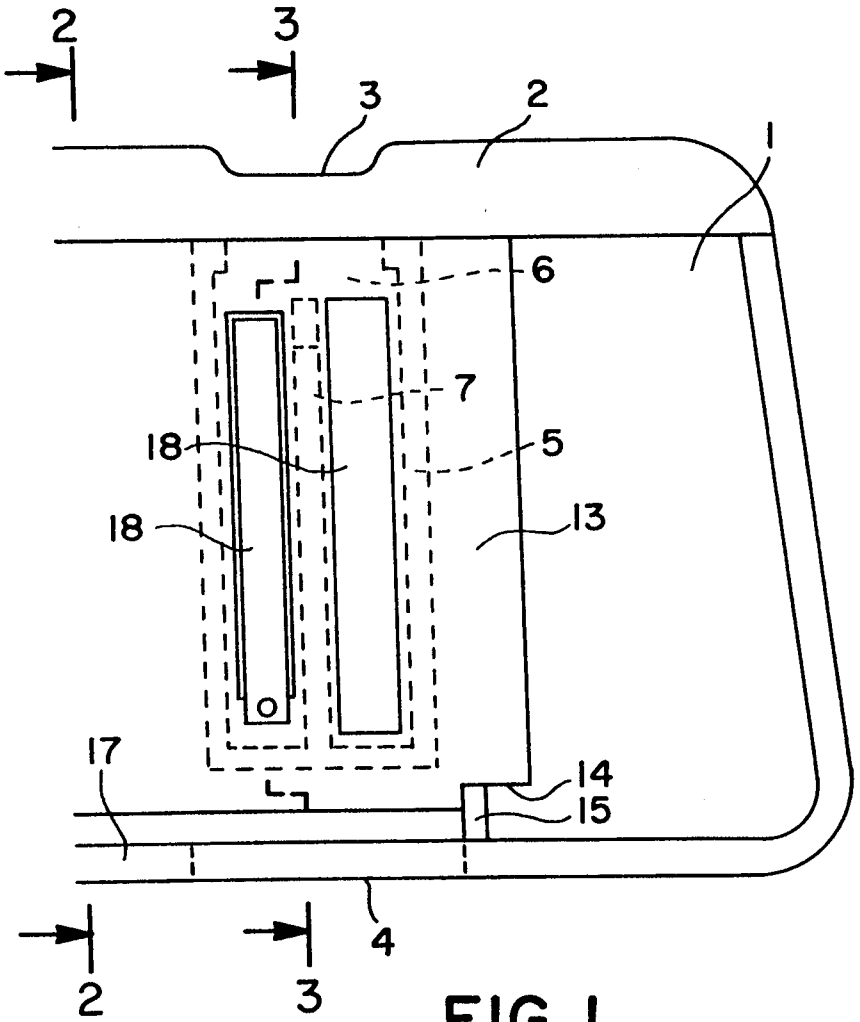
FIG. 1 is a partial plan view, partly broken away to depict elements, of a harmonica in accordance with the invention.

The harmonica is completed by the sounding board 13. As may best be seen from FIG. 1, sounding board 13 supports pairs of reeds 18, i.e., there are a pair of reeds 18 associated with each of the compartments 6. The sounding board 13 is provided, on a long side thereof which will be disposed oppositely with respect to the mouthpiece in the completed instrument, with a pair of step-shaped recesses 14, only one of which is shown. The recesses 14 cooperate, in the manner to be described, with inwardly directed projections 15 formed on the housing shell 1. When the harmonica is assembled, the sounding board 13 is inserted in the shell 1 so as to be supported on the free ends of the reed compartment walls 5. In this position, the recesses 14 on sounding board 13 each rest on an inwardly directed projection 15 of housing shell 1 and the opposite long side of sounding board 13 rests against the partitions 16 which define the ports 3 as may be seen from FIG. 2. In this position, the sounding board 13 also rests on a shoulder which forms an extension of the recess 8 as may be seen from FIG. 3. The position of sounding board 13 relative to the housing shell 1 is, accordingly, fixed.

The act of pushing the shoulder 10 on lid 9 into recess 8 will result in a first long side edge of sounding board 13 being clamped to the housing shell. As a result of subsequent inward pressing of the lid 9, the contact elements 11 will enter into engagement with the sounding board 13 and press the sounding board tightly against the free upper ends of the reed compartment walls 5. Further inward pressure applied to lid 9 will cause the engagement members 12 to be snapped into the air flow ports 4 to complete assembly of the instrument. Because of the force applied to the sounding board by the contact elements 11, the sounding board will be sealingly clamped against the reed compartment walls.

As will be obvious from the above discussion, final assembly of a harmonica in accordance with the present invention comprises manipulation of only three components, i.e., the housing shell 1, the lid 9 and the sounding board 13. These three components can be easily assembled without the use of additional fastening elements.

The harmonica depicted in the drawing has a wedge-shaped cross-section. This results in an ergonomically favorable shape in the mouthpiece and grip regions. As the instrument is played, during exhalation, air flows through the ports 3, the reed compartments 6, past the reeds 18, along the sounding board 13 and the inside of the lid and emerges at the ports 4. In the case of aspiration, the air flow is in the reverse sequence.

As may clearly be seen from FIG. 2, the snap-action mechanical connection of lid 9 to housing shell 1 can also, or additionally, be accomplished by providing locking surfaces on the web portions 17 of shell 1 which are disposed between the ports 4. This type of locking arrangement is depicted in FIG. 2.

As will be understood by those skilled in the art, the expiration/aspiration ports 4 could be provided on the lid 9 rather than on the housing shell 1. In such an arrangement, for example, the locking projections 12 would engage cut-outs provided in the housing shell 1.

As a further alternative, the reed compartment 6 can be subdivided into halves by partitions 7 and such partitions, if present, will offer additional bearing surfaces for the sounding board 13.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A harmonica comprising:

means defining a open-sided housing, said housing defining means including a first end portion which forms a mouthpiece, said mouthpiece having a first array of air flow ports, said housing defining means further including a back and a plurality of spaced apart generally parallel compartment walls extending therefrom;

sounding board means, said sounding board means being sized and shaped to be received in said housing and supported on the free ends of said compartment walls, said sounding board means cooperating with said housing back and compartment walls to define a plurality of reed compartments which are in fluid communication with respective of said ports of said first array, said sounding board means including at least a first reed positioned in registration with a cooperating slot located at a first side of each of said reed compartments; and means defining a lid for the open side of said housing, said lid defining means having a first attachment portion which mechanically engages the first end portion of said housing defining means, said lid defining means also having a second attachment portion disposed oppositely with respect to said first attachment portion, said second attachment portion mechanically engaging said housing defining means to lock said lid defining means to said housing defining means, said lid defining means further having a plurality of contact members which extend in the direction of said housing defining means back, said contact members engaging said sounding board means and urging said sounding board means against the ends of said compartment walls.

2. The harmonica of claim 1 wherein said mouthpiece forming first end portion of said housing defining means includes a recess and said first attachment portion of said lid defining means includes a first projection which is received in said recess.

3. The harmonica of claim 2 wherein said housing defining means first end portion further includes sounding board locating means, said locating means being juxtapositioned to said recess, and wherein a first edge region of said sounding board defining means is clamped between said lid defining means and said locating means.

4. The harmonica of claim 3 wherein said contact members comprise cam shaped projections.

5. The harmonica of claim 3 wherein said contact members resiliently engage said sounding board means.

6. The harmonica of claim 3 wherein said housing defining means includes a second end portion disposed oppositely with respect to said first end portion, said second end portion having a plurality of apertures, and wherein said second attachment portion of said lid defining means includes a plurality of hook-like members which engage said apertures.

7. The harmonica of claim 6 wherein said apertures comprise a second array of air flow ports for the harmonica.

8. The harmonica of claim 7 wherein said housing defining means further includes a plurality of web members located between said apertures, at least some of said web members having surface irregularities on the side thereof which faces toward the interior of said housing, said hook-like members also engaging said surface irregularities.

9. The harmonica of claim 7 wherein said contact members comprise cam-shaped projections.

10. The harmonica of claim 6 wherein said contact means comprise cam-shaped projections.

11. The harmonica of claim 3 wherein said housing defining means includes a second end portion disposed oppositely with respect to said first end portion, said second end portion having a plurality of apertures, said housing defining means further including web members located between said apertures, at least some of said web members having a locking surface on the side thereof which faces toward the interior of said housing, and wherein said second attachment portion of said lid defining means includes a plurality of hook-like members which engage said locking surfaces on said web members.

12. The harmonica of claim 11 wherein said apertures comprise a second array of air flow ports for the harmonica.

13. The harmonica of claim 12 wherein said contact members comprise cam-shaped projections.

14. The harmonica of claim 11 wherein said contact members comprise cam-shaped projections.

15. The harmonica of claim 3 wherein said recess in said housing defining means first end portion extends substantially the width of said mouthpiece and wherein said air flow ports of said first array are defined by said housing defining means back wall in cooperation with a discontinuous front wall portion of said housing defining means, said recess being formed in said front wall portion.

16. The harmonica of claim 15 wherein said recess is a cut-out formed in said port defining discontinuous front wall portion of said housing defining means first end portion and wherein said cut-out in part defines said locating means.

17. The harmonica of claim 16 wherein said housing defining means includes a second end portion disposed oppositely with respect to said first end portion, said second end portion having a plurality of locking surfaces, and wherein said second attachment portion of said lid defining means includes a plurality of locking projections which engage said locking surfaces.

18. The harmonica of claim 17 wherein said locking surfaces are first side surfaces of apertures of an array of apertures, said apertures comprising a second array of air flow ports for the harmonica.

19. The harmonica of claim 18 wherein said housing defining means second end portion further includes a plurality of web members located between said apertures, at least some of said web members having surface irregularities on the side thereof which faces toward the interior of said housing, said locking projections also engaging said surface irregularities.

20. The harmonica of claim 19 wherein said contact members comprise cam shaped projections.

* * * * *